United States Patent [19]

Heft et al.

[11] 3,953,812

[45] Apr. 27, 1976

[54] ELECTRIC CIRCUIT BREAKER

[75] Inventors: Eldon Bertel Heft, West Hartford; Joseph Francis Johnson, Plainville, both of Conn.

[73] Assignee: General Electric Company, New York, N.Y.

[22] Filed: Oct. 9, 1974

[21] Appl. No.: 513,397

[52] U.S. Cl. ..... 335/23; 335/24; 335/45

[51] Int. Cl.[2] ..... H01H 73/48

[58] Field of Search ..... 335/27, 35, 37, 38, 335/23, 24, 45

[56] References Cited

UNITED STATES PATENTS

| | | | |
|---|---|---|---|
| 3,061,698 | 10/1962 | Lyon | 335/37 |
| 3,098,136 | 7/1963 | Stanback et al. | 335/37 |
| 3,278,708 | 10/1966 | Casey et al. | 335/35 X |
| 3,401,363 | 9/1968 | Vyskocil et al. | 335/23 X |

*Primary Examiner*—G. Harris

*Attorney, Agent, or Firm*—Robert A. Cahill; Walter C. Bernkopf; Frank L. Neuhauser

[57] ABSTRACT

A circuit breaker designed for automated assembly includes pairs of fixed and movable contacts, the latter carried by a carrier mounted for reciprocating movement in the breaker case. Operating and trip mechanism parts are mounted on a frame positioned in the case. A handle slideably mounted by the case actuates the operating mechanism to open and closed circuit positions. A fixture is utilized with the frame for calibrating the thermal trip setting and for partial assembly of the operating mechanism.

26 Claims, 6 Drawing Figures

70
64
63
70a
63a
140
140a
140b
47
46
12a
40
78
42
36
38
112
124
125
82a
82
132
66
135
74
37
34
206
126
136
134
12
62
118
120
121
119
130
128
114
110
116
117
68
69
71
60

ELECTRIC CIRCUIT BREAKER

BACKGROUND OF THE INVENTION

Current molded case circuit breaker designs do not lend to assembly by machines, and thus are assembled largely by hand. The operating mechanisms of these circuit breakers are almost universally designed as a toggle or overcenter mechanism using spring force to sustain the ON and OFF circuit breaker conditions. The assembly of such mechanisms is not conductive to automation since the operating spring must be loaded incident to assembly and the ends thereof hooked to or otherwise engaged with elements of the mechanism. Moveover, mechanism elements of currently available circuit breakers are invariably designed with portions extending over and under or otherwise partially encompassing other elements, thus necessitating intricate manipulations of the parts of effect interconnection and assembly. Equipment to automate the assembly of such parts would be prohibitively complex and expensive.

It is accordingly an object of the present invention to provide a molded case circuit breaker capable of automated assembly.

An additional object of the invention is to provide a molded case circuit breaker of the above character wherein the component parts thereof are mounted and operatively interconnected in a simplified and facile manner.

Yet another object of the present invention is to provide a molded case circuit breaker of the above character which is quick-trip and trip-free.

Still another object is to provide a circuit breaker of the above character having improved interrupting capacity.

An additional object is to provide a molded case circuit breaker of the above character which is simple in design, inexpensive to manufacture and reliable in operation.

Other objects of the invention will in part be obvious and in part appear hereinafter.

SUMMARY OF THE INVENTION

In accordance with the present invention, there is provided a molded case circuit breaker of a unique and simplified design which lends itself to assembly with a minimum of hand labor and, in fact, is readily adapted for assembly by machines in an essentially automated fashion. To this end, the component parts of the circuit breaker are adapted for mounting and operative interconnection in a convenient and facile manner, fully within the capability of relatively non-complex material handling equipment. While the circuit breaker of the present invention is uniquely adapted for automated assembly, it will be appreciated from the detailed description to follow that conventional assembly by hand labor is simplified and thus markedly expedited.

Generally stated, the circuit breaker of the present invention includes a pair of fixed contacts which are bridged by a pair of movable contacts carried by a carrier mounted for reciprocating movement by the circuit breaker case. This double break feature provides for increased current interrupting capacity and also eliminates the need for a flexible conductive element typically used to electrically connect the movable contact ultimately to the circuit breaker load terminal. Since, in this situation, the element is flexed with each circuit breaker operation, rather precise positioning of the element in the case is required to insure against its failure. Such precise positioning of an elongated flexible element, such as conductive braid, would be difficult for automated equipment.

One of the fixed terminals is carried by a rigid conductive line strap positioned in the circuit breaker case, while the other fixed contact is carried by a load strap, likewise positionally mounted in the case and electrically connected at its other end to a trip mechanism. The trip mechanism is likewise electrically connected by a flexible conductive element to a load terminal lug. In this situation, the element is normally flexed infrequently and thus its positioning is not critical. The load strap-trip mechanism-load terminal sub-assembly is secured to a frame positionally mounted in the circuit breaker case. The frame in turn carries a plurality of pivot posts for pivotally mounting components of the circuit breaker operating mechanism and a latch operatively interfacing the trip mechanism and the operating mechanism.

An operating handle mounted by the case for movement between ON and OFF positions operatively engages the operating mechanism to position the movable contacts accordingly. A unique dual-action operating mechanism spring acts on the contact carrier to abruptly separate the fixed and movable contacts in the event of a trip function and then acts to reset the operating mechanism as the handle is returned to its OFF position by a separate handle spring, thereby concluding a trip function. The operating mechanism spring is in the form of a hairpin spring operating in compression between the operating mechanism and the contact carrier. Hook connections at the ends of the operating spring are avoided, thus simplifying assembly, particularly insofar as automated assembly is concerned. The handle spring is likewise a compression spring which is completely unloaded when the handle is in the OFF position, thus likewise simplifying assembly.

To simplify automated assembly and to facilitate calibration of the circuit breaker, a fixture is utilized in the initial assembly stages to accept and precisely locate the frame-trip mechanism-load strap-load terminal sub-assembly. Thusly located in a fixed spatial position, the overload trip level can be ready and precisely established in automated fashion, utilizing suitable means, such as a laser, to produce the requisite operative relationship between a thermal element of the trip mechanism and a trip mechanism latch.

In addition to precisely locating the frame-trip mechanism-load strap-load terminal sub-assembly, the fixture further includes locating posts which project through apertures in the frame to preliminarily mount and precisely locate various otherwise movable links of the operating mechanism. Thusly positioned, the operating mechanism links can be assembled seriatim in interconnecting relation using automated equipment.

The partial assembly is then transferred to the base portion of the circuit breaker case, which serves as the fixture for the assembly of the remaining circuit breaker components.

The invention accordingly comprises the features of construction, combination of elements and arrangement of parts which will be exemplified in the construction hereinafter set forth, and the scope of the invention will be indicated in the claims.

For a further understanding of the nature and objects of the invention, reference should be had to the following detailed description taken in connection with the accompanying drawings in which:

FIG. 3 is an exploded perspective view illustrating the initial assembly of various circuit breaker components into a sub-assembly using a fixture;

FIG. 3A is a longitudinal, sectional view of an operating mechanism link, illustrating its unique configuration adapting it for assembly on the fixture of FIG. 3;

Like reference numerals refer to corresponding parts throughout the several views of the drawings.

DETAILED DESCRIPTION

Figure 1:
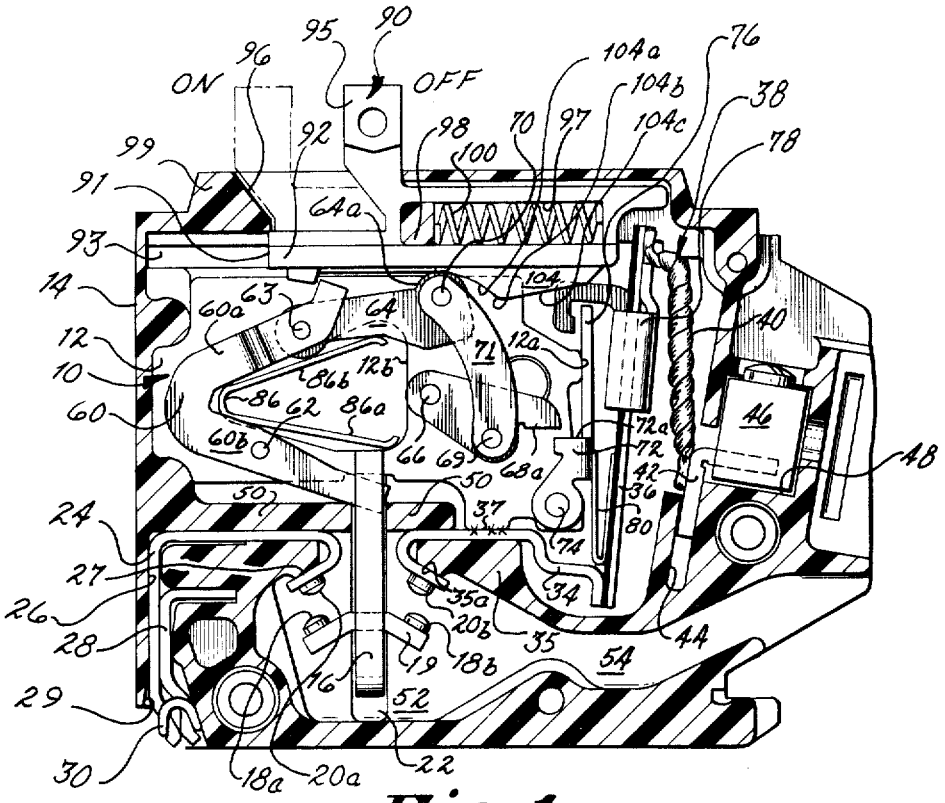
FIG. 1 is a plan view, with cover removed, of an embodiment of the present invention showing the positions of the various parts when the circuit breaker is in the open-circuit or OFF condition.
Figure 2:
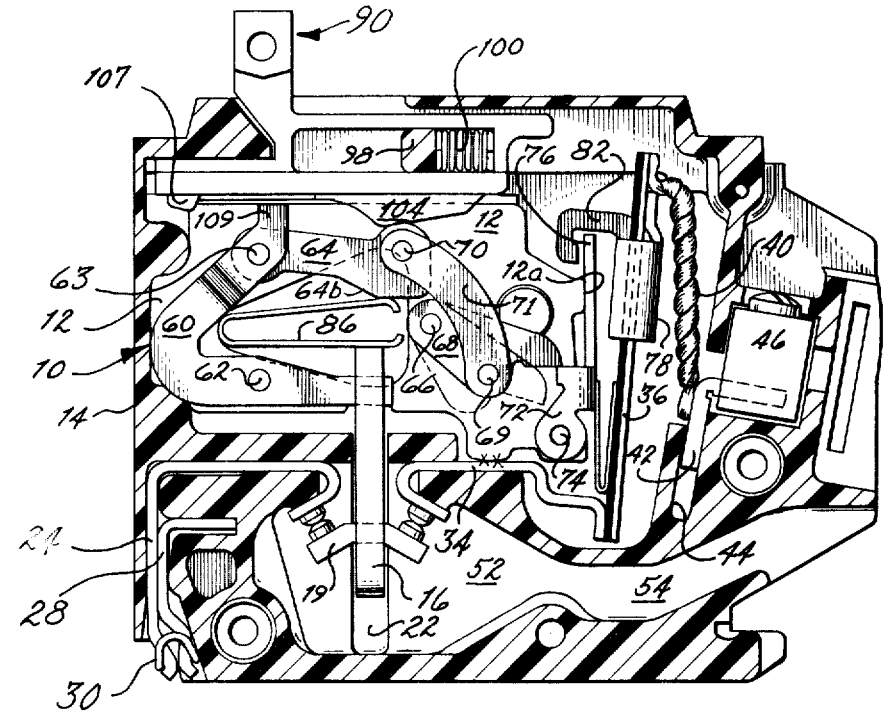
FIG. 2 is a plan view, with cover removed, showing the positions of the various parts when the circuit breaker is in the closed circuit or ON condition.
Figures 5, 5A:
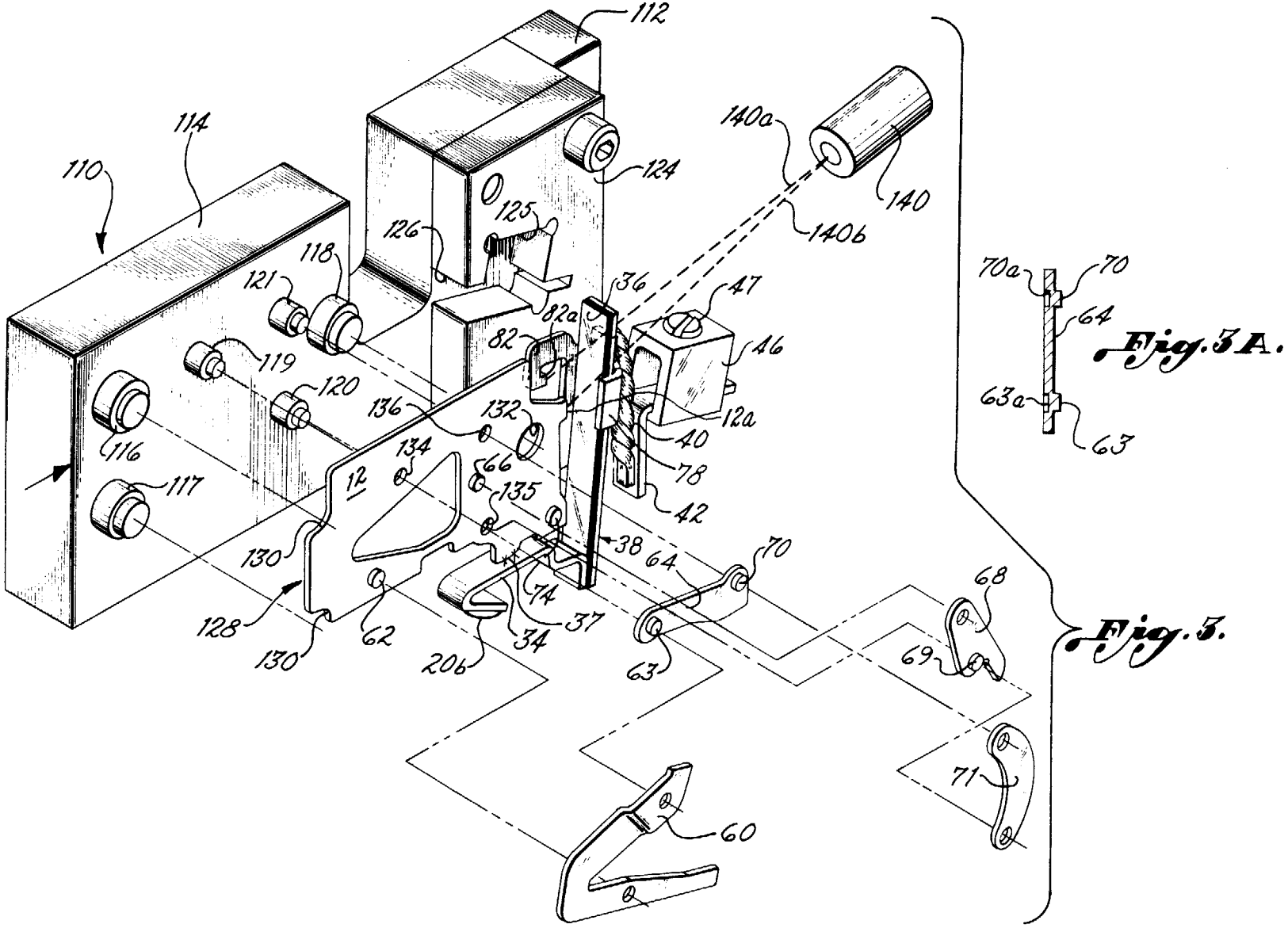
FIG. 5 is a plan view of the cover of the circuit breaker case.

Referring now to the drawings, the circuit breaker of the present invention, as best seen in FIGS. 1 and 2, includes an operating mechanism, generally indicated at 10, mounted by a plate 12 positioned within a circuit breaker case consisting of a base 14 (FIGS. 1 and 2) and a cover 15 (FIG. 5). Operating mechanism 10 reciprocates a member 16 carrying a pair of movable contacts 18*a*, 18*b* between positions of engaging and disengaging relation with a corresponding pair of fixed contacts, 20*a*, 20*b*. Movable contacts 18*a*, 18*b* are mounted on opposite ends of a conductive bridge member 19 supported by carrier 16. The carrier member is, in turn, mounted for reciprocating movement in opposed grooves 22 molded in the case 14 and cover 15 (FIG. 5). Fixed contact 20*a* is mounted on the turned-back end portion of a generally L-shaped line strap 24 lodged in opposed grooves 26 formed in the base 14 and cover 15. The contact carrying, turned-back end portion of line strap 25 is backed by shoulders 27 molded in the base and cover. A conductive stab 28, also lodged in groove 26, cooperates with line strap 24 to provide a line terminal stab connector where the two parts exit the circuit breaker case at 29. A spring clip 30 urges the stab connector portions of the line strap and stab together, so as to insure good electrical contact with a male line stab (not shown) in a circuit breaker panelboard.

The other fixed terminal 20*b* is carried by the turn-back end portion of a load strap 34 which is positionally located within the case by opposed barriers 35 molded in the base and cover. Shoulders 35*a* of barriers back the contact carrying portion of load strap 34. Load strap 34 is also affixed to frame 12 at 37 by suitable means, such as welding, and is also electrically connected to and serves to mount a bimetallic element 36, included in a trip mechanism, generally indicated at 38. The other upper end of bimetallic element 36 is electrically connected by flexible conductive element 40 to an L-shaped terminal strap 42 having one leg lodged in opposed base and cover grooves 44. The other leg of terminal strap 42 extends into the open interior of a load terminal lug 46 which is captured in opposed cavities 48 formed in the base and cover.

From the description thus far, it is seen that the circuit through the circuit breaker can be traced from the line stab terminal through line strap 24, fixed contact 20*a*, movable contacts 18*a*, bridge 19, movable contact 18*b*, fixed contact 2*b*, load strap 34, bimetallic element 36, braid 40, and L-shaped terminal strap 42 to terminal lug 46. It will be noted that mounting the fixed contacts on the turned-back end portions of the line and load straps is effective to generate magnetic blowout forces during an interruption which are operative to propel the arc from an arc chamber 52 out through a vent passage 54, both molded in the circuit breaker base and cover. This magnetic blowout feature coupled with the double break contacts affords the circuit breaker of the present invention materially increased circuit interrupting capability. In addition, the base and cover are formed with cooperating barrier sections 50 on each side of the grooves 22 accommodating carrier member 16, which are effective to prevent the arc from propagating up into the operating mechanism 10 of the circuit breaker.

Still referring to FIGS. 1 and 2, the operating mechanism 10 includes a V-shaped operating arm 60 having an upper arm segment 60*a* and a lower arm segment 60*b*, the latter being apertured at a location approximate its mid-length to receive a pivot post 62 carried by frame 12 for pivotally mounting the arm 60. The terminal portion of arm segment 60*b*, as seen in FIGS. 1 and 2, engages the upper end of the movable contact carrier member 16 (best seen in FIG. 4), while the terminal portion of arm segment 60*a* is apertured to receive a pivot post 63 carried adjacent the left end of a cam link 64, thus pivotally interconnecting the operating arm 60 and the cam link.

Frame 12 carries a second post 66 adapted to pivotally mount a latch link 68. The latch link carries a pivot post 69, as does the right end of cam link 64, as indicated at 70. An arcuate link 71 is apertured adjacent each end to receive posts 69 and 70, pursuant to interconnecting the latch link and the cam link. Under normal conditions, pawl tip 68*a* of latch link 68 abuts a latch 72 pivotally mounted on a third pivot post 74 carried by frame 12. Latch 72, in turn, carries an armature 76 which is attracted by an electromagnet 78 mounted in partial embracing relation with the bimetallic element 36. A hairpin spring 80 positioned between the bimetallic element 36 and the latch 72 biases the armature 76 against a stop 12*a* formed on frame 12 so as to establish a maximum air gap between the armature and the electromagnet 78. As will be seen, in the event of a short circuit, armature 76 is attracted toward eletromagnet 78, thereby pivoting latch 72 in the clockwise direction to release latch link 78 and trip the circuit breaker. A hook 82 is also mounted by bimetallic element 36 in position to engage and pivot the armature upon deflection of the bimetallic element in response to an overload condition, thereby disengaging the latch 72 from latch link 68 and causing a trip function.

Armature 76 is preferably coated with an insulative material, such as phosphate, silicone, varnish, etc., so as to preclude the possibility of establishing a low impedance current path including hook 82 and armature 76 which would shunt the lower portion of bimetallic element 36, including that portion about which the electromagnet 78 is disposed. It will be appreciated that, should this be permitted to occur, the magnetic trip function of the circuit breaker would be defected.

Upon release of latch link 68 by latch 72, the operating mechanism 10 is released to enable an operating mechanism spring, in the form of a V-shaped leaf or hairpin spring 86, to power the trip and reset functions of the circuit breaker. Spring 86, as seen in FIGS. 1 and 2, is retained in its operative position in a triangular-shape aperture 12*b* in frame 12. As will be described, resilient leg 86*a* of spring 86 acts on carrier 16 to separate the contacts and thus trip the breaker, and then resilient leg 86*b* acts to reset the operating mechanism 10 preparatory to reclosure of the circuit breaker contacts.

To accommodate manual operation of the circuit breaker, an operating handle, generally indicated at 90, is slidingly mounted by the circuit breaker case. To this end, operating handle 90 is formed having a base 91; the lateral edges thereof being formed as runners 92 which are received in opposed, elongated runner grooves 93 molded in the circuit breaker base and cover. A knob 95 extends upwardly through an opening 96 in the circuit breaker case so as to be accessible for digital handle manipulation. Handle 90 is further provided with an elongated central opening 97 in which is received an abutment 98 molded on the circuit breaker base. This abutment serves to define the extreme rightward, OFF position of handle 90. A coil spring 100 is positioned in the central opening 97 between the right end thereof and the abutment. As seen in FIG. 1, when the handle is in its rightmost, OFF position, spring 100 is essentially relaxed and unloaded. When the handle 90 is moved to its leftmost or ON position, against case abutment 99, spring 100 is compressed between the abutment 99 and the right termination of the handle slot, thus acting to bias the handle toward its OFF position.

As best seen in FIGS. 1 and 2, depending from the bottom of handle 90 is a cam 104 having a relatively steep leading cam face 104*a* to the left of a peak 104*b* and a gradually sloping, trailing cam face 104*c* to the right of the peak. This cam, movable with handle 90, operates on the right end of cam link 64 which is enlarged and rounded to provide a cam follower 64*a*. As seen in FIG. 2, with handle 90 in the left or ON position, cam link follower 64*a* is bearing against the trailing cam surface 104*c* under the urgence of resilient leg 86*b* of operating mechanism spring 86, thus maintaining the ON position of the handle against the bias of handle spring 100.

With handle 90 in its rightmost OFF position, as seen in FIG. 1, the handle cam 104 is to the right of the cam follower 64*a* of cam link 64. Resilient leg 86*b* of operating spring 86 therefore is capable of elevating the cam link, which is effective to pivot the latch link 68 counterclockwise to insure that its pawl tip 68*a* is above the level of the latching surface 72*a* of latch 72. This OFF condition is also the reset condition the components assume immediately following a trip function.

As the handle 90 is moved to the left toward the ON position, the cam follower 64*a* of cam link 64 begins riding down on leading cam surface 104*a*. Cam link 64 is thus depressed, forcing via link 71, latch link 68 to swing clockwise on its fixed pivot post 66 through a brief arc to the point where its pawl tip engages latching surface 72*a* of latch 72. With further clockwise pivotal movement of latch link 68 being constrained by latch 72, continued movement of the handle 90 to the handle 90 to the left forces the cam link 64 to also propagate downward and to the left. This causes the operating arm 60 to swing counterclockwise about its fixed pivot post 62, raising arm segment 60*b* and with it the contact carrier 16. Elevation of carrier 16 forces resilient leg 86*a* upwardly to load operating spring 86. Depression and leftward movement of cam link 64 by handle cam 104 also forces resilient leg 86*b* of operating spring 86 downwardly. When the cam follower end 64*a* of the cam link reaches the peak 104 *b* of handle cam 104, carrier member 16 has been elevated to the point where the movable contacts engage the fixed contacts in slow-make fashion. At the conclusion of the leftward movement of handle 90 to its ON position, the cam follower end 64*a* of cam link 64 rides over the peak 104*b* of handle cam 104 onto the trailing cam surface 104*c* thereof. As previously noted, operating spring 86 presses the cam link follower 64*a* against the handle cam 104 with sufficient pressure to offset the bias of handle spring 100 urging the handle toward its OFF position, thus achieving a stable closed circuit condition.

In the event of an overcurrent condition sensed by bimetallic element 36 or a short circuit condition sensed by electromagnet 78, armature 76 is pivoted in the clockwise direction about pivot post 74, causing latch 72 to release latch link 68. The components of the operating mechanism are thus released to swing around generally in the clockwise direction under the urgence of the operating spring 86. More specifically, resilient leg 86*a* of the operating spring forces the contact carrier 16 down to abruptly initiate contact separation. Operating arm 60 is thus pivoted about pivot post 62 in the clockwise direction, forcing cam link 64 to the right as seen in FIG. 2. Latch link 68 swings clockwise about its pivot post 66 (as indicated in phantom in FIG. 2), and the cam link follower 64*a* rides up on the trailing cam surface 104*c* of handle cam 104. Movement of cam link 64 to the left is further assisted by the free end of resilient leg 86*b* of operating spring 86 acting against a sloping cam surface 64*b* provided along the lower edge of cam link 64. The assistance of resilient leg 86*b* afforded to leg 86*a* is effective to accentuate the abruptness of contact separation in true quick-trip fashion. It should be noted that contact separation during a trip function is achieved without movement of the handle 90, thus rendering the circuit breaker of the present invention trip free. That is, the circuit breaker will trip under abnormal current conditions even though handle 90 is restrained in the ON position.

At this point, the trip function has been concluded, and a reset function is now initiated. Resetting of the circuit breaker is commenced by the return of handle 90 to its OFF position by handle spring 100. As the cam link follower 64*a* rides down on the trailing cam surface 104*c* of handle cam 104, cam link 64 is pivoted downwardly about its pivotal connection with operating arm 60. The unrestrained latch link 68 pivots further in the clockwise direction to accommodate depression of the right end of cam link 64. On continued movement of handle 90 toward its OFF position, the cam link follower 64*a* rides over the peak 104*b* of handle cam 104 and up the leading cam surface 104*a*. At this point, resilient leg 86*b* of operating spring 86 raises the right end of cam link 64, thereby pivoting latch link 68 in a couterclockwise direction about its pivot post 66. When handle 90 reaches its OFF position, cam link follower 64*a* is to the left of leading cam surface 104*a* and the pawl tip 68*a* of latch link 68 has been elevated to a point above the latching surface 72*a* of latch 72.

Assuming latch 72 has returned to its latching position with its latching surface 72*a* in intercepting relation with the pawl tip 68*a* of latch link 68, the operating mechanism 10 can be manipulated by handle 90 toward its closed circuit condition. If, however, the latch 72 is not returned to its latching position, it is seen that movement of the handle 90 toward the ON position merely depresses cam link 64, resulting in clockwise rotation of latch link 68 without counterclockwise rotation of operating arm 60 about its pivot post 62. As previously noted, the circuit breaker of the invention is trip free such that unlatching movement of latch 72 collapses the operating mechanism 10 should an attempt be made to close the circuit breaker on an abnormal circuit condition, such as short circuit.

To open the circuit breaker using handle 90, it is seen that rightward movement of the handle from its position in FIG. 2 causes the cam link follower 64*a* to ride over the cam peak 104*b* and up the leading cam surface 104*a*. Cam link 64 is forced upward and to the right by leg 86*b* of operating spring 86, causing operating arm 60 to swing clockwise. Arm segment 60*b* is lowered, releasing carrier 16 and spring arm segment 86*a* forces the carrier downward to separate the contacts.

Handle 90, as seen in FIGS. 1 and 2, carries a depending projection 107 which serves as a kicker for impacting against an upwardly extending projection 109 at the termination of arm segment 60*b* of operating arm 60 as the handle is returned to its OFF position by handle spring 100 should the contacts not initially separate during a trip function. It is seen that should the contacts become welded as the circuit breaker is attempting to execute a trip function, such that contact separation cannot be effected by operating spring 86 alone, release of latch link 68 by latch 72 will nevertheless permit handle 90 to return toward its OFF position. In so doing, kicker 107 will impact against projection 109 of operating arm 60 generally with sufficient force to break the contact weld and precipitate initial contact separation; full separation being effected by operating spring 86. Under normal conditions, operating arm 60 will have been rotated about its pivot 62 in separating the contacts and thus the movement of projection 109 to the right precedes the rightward movement of kicker 107 so that impact therebetween is avoided.

Figure 4:
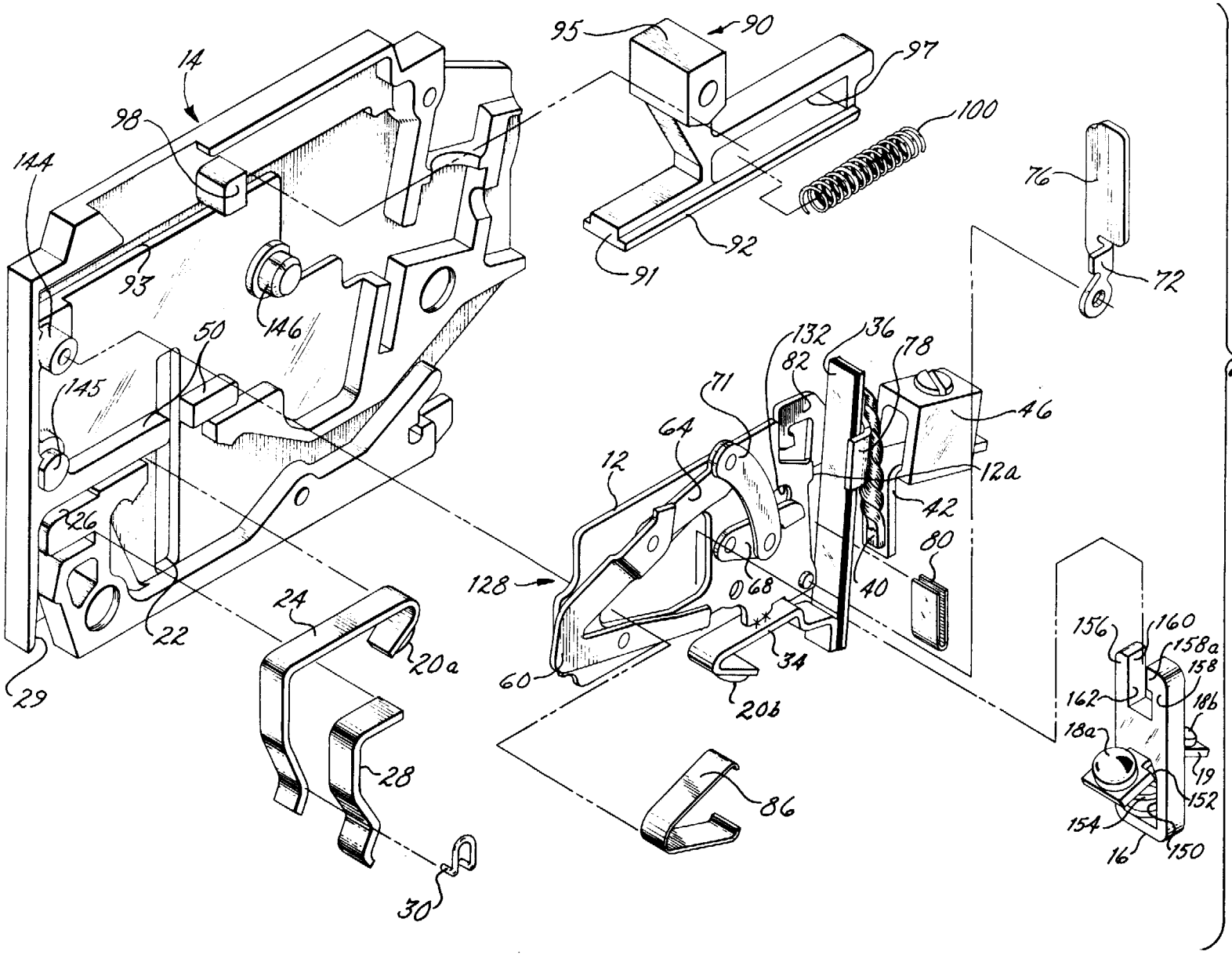
FIG. 4 is an exploded perspective view illustrating the assembly of the sub-assembly of FIG. 3 and the remaining circuit breaker components into the base of the circuit breaker case.
Figure 5:
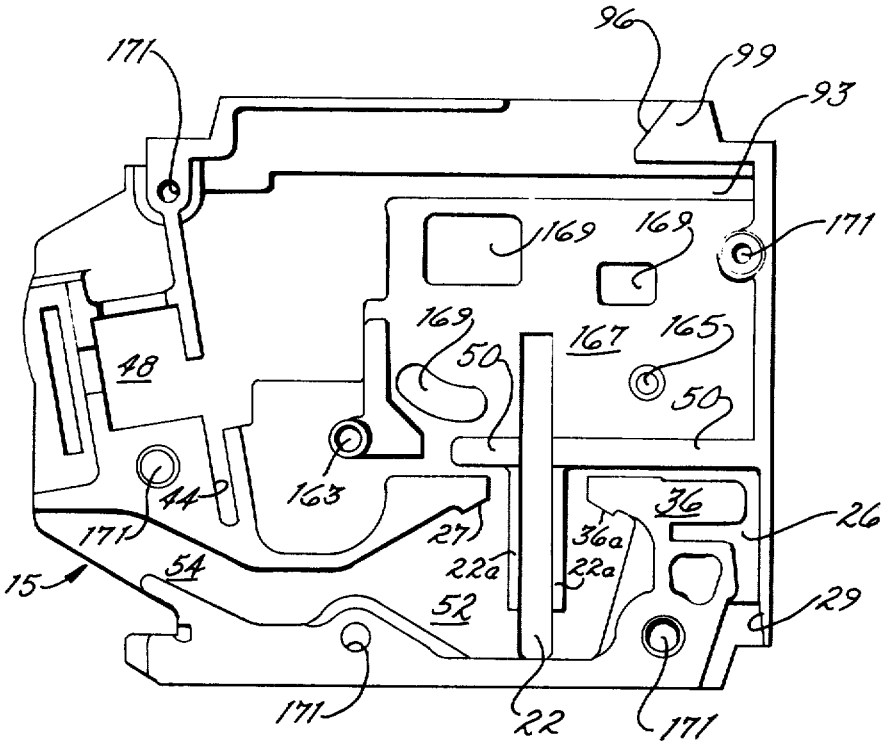

The method of assembly of the circuit breaker of the present invention is illustrated in the exploded assembly views of FIGS. 3 and 4. Referring first to FIG. 3, initial assembly, in accordance with the present invention, is carried out using a fixture, generally indicated at 110. It will be appreciated that, in practice, fixture 110 is positioned horizontally against a reference stop, indicated at 112. The fixture includes a block 114 mounting a series of upright, shouldered frame mounting posts 116, 117, 118 and a series of upright, shouldered link mounting posts 119, 120, 121. A plate 124 secured to block 114 is suitably machined to provide a cavity 125 having a side entry, indicated at 126.

The first assembly step is, as illustrated in FIG. 3, the mounting of the sub-assembly consisting of frame 12, load strap 34, trip mechanism 38, flexible member 40, terminal strap 42 and lugs 46 on the fixture 110. This sub-assembly, generally indicated at 128, is formed by welding fixed contact 20*b* to the turned-back end portion of load strap 34 and by welding the lower end of the bimetallic element to the load strap. One end of flexible member 40 is welded to the upper end of the bimetallic element and the other end is welded to the L-shaped terminal strap 42. Lug 46 is held captive on the other end of the terminal strap by the lug screw 47. Electromagnet 78 and hook 82 are welded to the bimetallic element 36. Load strap 34 is welded to the frame at 37, as previously described. Insofar as the present invention is concerned, the order of creation of this sub-assembly is not significant.

The corners at the left end of frame 12 are relieved, as indicated at 130, such that the frame sits on the shouldered portions of mounting posts 116 and 117. The necked-down terminations of these mounting posts engage the edge of the frame 12 to precisely locate this end of sub-assembly 128 on the fixture. The right end of frame 12 is seated on the shoulder of mounting post 118, with the necked-down termination thereof projecting through an aperture 132 in the frame so as to precisely position the sub-assembly 128 on the fixture 110. Thusly mounted, the necked-down terminations of link mounting posts 119, 120 and 121 project through apertures 134, 135 and 136, respectively, in the frame 12. Lug 46 is accommodated in cavity 125 of the fixture, with the extension of terminal strap 42 into the lug accommodated in the entry 126 into the cavity. It will be observed that mounting the frame on the shoulders of mounting posts 116–118 displaces the frame from the face of fixture block 114 in order that the lower edge of the load strap 34 and the lower portion of the trip mechanism 38 not rest on the fixture block.

It is an important feature of the present invention that the various parts of sub-assembly 128 are mounted on fixture 110 in precisely the same relative positions they ultimately assume in the circuit breaker case. Thus, while in the fixture, the bimetallic element 36 and hook 82 assume the same positions relative to the armature stop 12*a* carried by frame 12 as they will assume in the circuit breaker case. This makes it possible to calibrate the thermal trip setting of the circuit breaker at this point in the assembly. This is in dramatic departure from the existing practice of providing a calibrating screw in the circuit breaker case which, after completed assembly of the circuit breaker, is selectively turned to adjust the orientation of the bimetallic element so as to achieve the requisite coupling relationship between it and the latch for the thermal trip setting desired.

It will be appreciated that with the manufacturing tolerances permitted in each of the sub-assembly parts and the joining and mounting of the sub-assembly parts, the positional relationship of the hook tip 82*a* and the armature stop 12*a* of frame 12 will vary from sub-assembly to sub-assembly. As can be seen from FIGS. 1 and 2, this positional relationship establishes the spacing between the armature 82 and the hook, and thus the extent of free travel of the armature to begin pivoting the latch 72 out from under the latch link 68 incident to an overload trip function. Obviously, deviations in this spacing or free travel of the bimetallic element will create corresponding deviations in the thermal trip setting of the circuit breakers.

To establish a uniform spacing between the hook tip 82*a* and the armature 76 from circuit breaker to circuit breaker, it is an important feature of the present invention to utilize a laser 140 to trim away the hook tip while the sub-assembly is in fixture 110. Since the fixture is spatially positioned against stop 112 and the sub-assembly 128 is precisely spatially positioned by the fixture, laser 140, fixedly positioned to direct a beam 140*a* toward the hook tip, is capable of removing precisely the correct amount of material so as to achieve the requisite positional relationship between the hook tip and the armature stop 12*a*. Since, as seen in FIGS. 1 and 2, armature 76 is biased against the armature stop 12*a*, the requisite amount of free travel for the thermal trip setting desired can thus be automatically established with precision from unit to unit. It will be appreciated that, if desired, the circuit breaker could be calibrated without bimetal free travel, in which case the hook tip 82*a* is trimmed such that the armature 76 is normally in essentially abutting relation with hook tip 82*a*. The use of the laser beam to calibrate the thermal trip setting has the distinct advantage of not creating any forces tending to deflect the bemetallic element 36 during the machining of the tip 82 *a* of hook 82. Thus, calibration uniformity from circuit breaker to circuit breaker is readily achieved.

It will be appreciated that calibration may also be accomplished by laser trimming the armature stop 12*a* rather than the hook tip 82, as indicated by laser beam 140*b*. Alternatively, a projection on the armature which abuts the armature stop 12*a* could be trimmed. It will also be appreciated that more conventional calibrating techniques, such as bending the bimetallic element 36 or its mount, load strap 34, can also be utilized.

After calibrating the thermal trip setting, cam link 64 is mounted on the neck-down terminations of link mounting posts 119 and 121 projecting through apertures 134 and 136 in frame 12. To accommodate this mounting of cam link 64 on fixture 110, this element, as seen in FIG. 3A is formed with recesses 63*a* and 70*a* in its back surface in registry with pivot posts 63 and 70, respectively, formed on the opposite surface. The registered recesses and pivot posts can be readily simultaneously formed on opposite sides of the cam link in a simple stamping operation effective to offset the link material. The necked-down terminations of link mounting posts 119 and 121 are received in the recesses 63*a* and 70*a*, respectively, of cam link 64 to locate this element relative to the frame 12. Operating arm 60 is then dropped into place with frame pivot post 62 received in the aperture formed in the terminal portion of arm segment 60*a*. It will be seen that the positional mounting of the cam link 64 by link mounting posts 119 and 121 establishes the requisite positional relationship between pivot posts 62 and 63 such that the operating arm 60 can be merely dropped into place by automated equipment.

Latch link 68 is then pivotally mounted on the frame pivot post 66. In order to properly orient the latch link for assembly, a recess (not shown) formed in the back surface of the latch link in registry with pivot post 69 receives the necked-down termination of link mounting post 120 of fixture 110. This recess is formed in the same fashion as previously described in connection with cam link 64 and illustrated in FIG. 3A. With the pivot post 70 of cam link 64 and pivot post 69 of latch link 68 in proper relative positions, link 71 with apertures at each end to receive these pivot posts is merely dropped into place to pivotally interconnect the cam and latch links. It is seen that the link mounting posts 119–121 serve the important function of spatially orienting each operating mechanism link as it is dropped into place such that interconnection of the links can be effected simply using automated equipment.

Once the operating mechanism links have been pivotally interconnected, the function of the link mounting posts 119–121 has been served, and the assembled parts of FIG. 3 can be transferred to the base 14 of the circuit breaker case, as illustrated in FIG. 4. Base 14 is provided with molded, shouldered posts 144, 145, 146, equivalent to posts 116, 117, 118 of fixture 110, for positionally mounting the partial assembly transferred from the fixture of FIG. 3. Thus, frame 12 rests on the shoulders of these case mounting posts, with the necked-down terminations of posts 144 and 145 accommodated in the left end corner reliefs 130 of frame 12 to locate that end of the partial assembly in the base 14, and the neck-down termination of post 146 is received in frame aperture 132 to precisely locate the other end of the partial assembly. The lug 46 is dropped into base cavity 48 with load terminal strap 42 accommodated in base groove 44.

The line strap 24 and stab 28 are dropped into groove 26 in the base 14, and spring clip 30 is fitted about the stab termination of these two members. The latch 72-armature 76 combination is placed on its pivotal mounting post 74 carried by frame 12. Hairpin armature spring 80 is placed between armature 82 bimetallic element 36 to bias the former against stop 12*a* on frame 12. Handle 90 is dropped into place in its OFF or far right position with its lower runner 92 accommodated in runner groove 93 formed in base 14. Handle spring 100 can then be dropped into the opening 97 in handle 90 between the abutment 98 on base 14 and the right end of the handle opening.

Contact carrier 16 is uniquely structured in accordance with the present invention so as to permit its assembly in a facile manner fully within the capability of automated handling equipment. Thus, as seen in FIG. 4, carrier 16 is in the form of an elongated rectangular member formed of insulating material having a lower elongated opening 150. Bridge 19 bearing the movable contacts 18*a*, 18*b* is provided with opposed notches 152 located essentially at mid-length which engage the contact carrier 16 along the sides of the opening 150 therein. A spring 154 captured in opening 150 beneath the bridge 16 biases the movable contacts upwardly against the upper end of opening 150. It will be appreciated that this resilient mounting of the movable contacts to contact carrier 16 serves, during contact closure, to insure proper seating of the movable contacts on the fixed contacts with adequate contact pressure.

The upper portion of carrier 16 is formed with spaced projections 156 and 158; the former being essentially straight and the latter having its terminal portion turned inwardly to provide a hook 158*a*. The hooked end 158*a* of projection 158 terminates short of projection 156 to provide a gap 160 affording longitudinal entry into the opening 162 between projections. To assemble this movable contact carrier sub-assembly to the previously assembled parts, gap 160 is of a width slightly in excess of the combined thicknesses of the terminal portion of arm segment 60*b* of operating arm 60 and frame 12. Thus, in assembling the movable contact carrier sub-assembly, carrier 16 is lined up with groove 22 in base 14 and, from a slightly elevated position below the end of arm segment 60*b* in its orientation shown in FIG. 1, is moved upwardly. Terminal portion of arm segment 60*b* and the portion of the frame therebelow enter gap 160 in carrier 16. Once the terminal portion of operating arm segment 60*b* moves into opening 162 beyond gap 160, the contact carrier sub-assembly is released to drop into its operating position. So positioned, it will be noted that the terminal portion of operating arm segment 60*b* is caught under the hooked termination 158 and thus the operating arm 60 is capable of moving the carrier 16 upwardly to bring the contacts into engaging relation.

The cover 15 of FIG. 5 is essentially a mirror image of the base 14 of FIGS. 1, 2 and 4. The major difference between the cover and base is the formation of molded pads 163 and 165 on the cover; which, with cover in place, bear against the terminations of frame pivot posts 62 and 74, respectively, to preserve the pivotal mountings of operating arm 60 and latch 72. The wall 167 of cover 15 bears lightly against link 71 and the terminal portion of operating arm segment 60*a* to perserve their pivotal connections with posts 69, 70 and 73. Depressions 169 molded in cover will 167 afford clearance for the terminations of these pivot posts as they move about during articulation of operating mechanism 10. The further insure against arc propagation up into the operating mechanism area, the grooves 22 in the base and cover accommodating the reciprocating carrier 16 are provided with raised sides 22*a*, as best seen in FIG. 5. Finally, the base and cover are provided with holes 171 registering upon application of the cover to the base for the acceptance of rivets (not shown) serving to maintain the circuit breaker case enclosure.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. An electric circuit breaker comprising, in combination:

A. an insulative case;

B. a frame positionally mounted in said case;

c. a trip mechanism mounted by said frame;

D. an operating mechanism mounted by said frame;

E. at least one fixed contact and one movable contact;

F. a contact carrier for said movable contact mounted by said case for reciprocal movement between open and closed contact positions, said carrier operatively connected to said operating mechanism for movement to said open and closed contact positions;

G. an operating handle mounted by said case and acting on said operating mechanism to effectuate said open and closed contact positions; and H. an operating spring acting on said carrier to separate said contacts and on said operating mechanism to automatically reset said operating mechanism immediately following a trip function.

2. The electric circuit breaker defined in claim 1, which includes a pair of fixed contacts and a pair of movable contacts.

3. The electric circuit breaker defined in claim 2, wherein said operating spring is V-shaped having a first resilient leg acting on said carrier and a second resilient leg acting on said operating mechanism.

4. The electric circuit breaker defined in claim 3, wherein said operating mechanism includes a link having a cam surface, said second resilient leg acting on said link cam surface to articulate said operating mechanism and thereby assist the action of said first resilient leg on said carrier in effecting abrupt separation of said contacts.

5. The electric circuit breaker defined in claim 3, wherein said frame includes means forming an opening therein accommodating said spring for retention in operative position.

6. The electric circuit breaker defined in claim 2, wherein said operating mechanism includes a link having a cam follower, and said handle carries a cam which acts on said cam follower during movement of said handle between ON and OFF positions to effectuate respectively said closed and open contact positions.

7. The electric circuit breaker defined in claim 6, wherein said operating spring biases said cam follower against said cam.

8. The electric circuit breaker defined in claim 7, wherein said handle is spring biased toward said OFF position, whereby said handle is automatically returnable to said OFF position at the conclusion of a trip function.

9. The electric circuit breaker defined in claim 2, wherein said handle is slideably mounted by said case for reciprocating movement between ON and OFF positions corresponding respectively to said closed and open contact positions.

10. The electric circuit breaker defined in claim 9, which further includes a handle spring for biasing said handle toward said OFF position, said ON position of said handle sustained against said handle spring bias by said operating spring.

11. An electric circuit breaker comprising, in combination:

A. an insulative case;

B. a frame positioned in said case, said frame carrying first, second and third pivot posts;

C. a trip mechanism including a latch pivotally mounted on said first pivot post;

D. a pair of fixed contacts and a pair of movable contacts;

E. a carrier for said movable contacts, said carrier mounted for reciprocating movement within said case;

F. an operating arm pivotally mounted on said second pivot post, said arm having a first end and a second end operatively engaging said carrier;

G. a latchable member pivotally mounted on said third post for engagement with said latch;

H. linkage means pivotally connected at one end to said latchable member and at the other end to said first end of said operating arm; and I. an operating handle mounted in said case for movement between ON and OFF positions, said handle operable incident to its movement to effect pivoting of said arm and thereby reciprocation of said carrier to translate said movable contacts between positions of engaging and disengaging relation with said fixed contacts.

12. The electric circuit breaker defined in claim 11, which further includes an operating spring acting on said carrier to abruptly disengage said contacts when said trip mechanism latch releases said latchable member to initiate a trip function.

13. The electric circuit breaker defined in claim 12, wherein said operating spring is V-shaped having a first resilient leg acting on said contact carrier and a second resilient leg acting on said linkage means to reset the circuit breaker.

14. The electric circuit breaker defined in claim 13, wherein said linkage means comprises a cam link and connecting link pivotally interconnected adjacent respective one ends thereof, the other end of said cam link pivotally connected to said first end of said operating arm and the other end of said connecting link pivotally connected to said latchable member.

15. The electric circuit breaker defined in claim 12, wherein said carrier includes a pair of spaced, longitudinally extending projections defining a slot therebetween, one of said projections having a hooked termination defining a constricted entry into said slot accommodating passage of said second end of said operating arm during assembly, said second end being operational captured in said slot and engaging said hooked termination of said one projection to translate said carrier and movable contacts into engaging relation with said fixed contacts.

16. The electric circuit breaker defined in claim 15, wherein said carrier further includes means defining a longitudinally elongated opening therein, said movable contacts mounted adjacent the ends of a conductive bridge element captured in said opening, and a spring captured in said opening and acting on said bridge to resiliently press said movable contacts into electrically engaging relation with said fixed contacts.

17. The electric circuit breaker defined in claim 15 which further includes an arc chamber formed in said case for accommodating said fixed and movable contacts, a vent passage formed in said case venting said arc chamber to the exterior of said case, a barrier formed in said case, opposed slots formed in said case for slidingly mounting said carrier, said carrier extending through an interruption in said barrier for operative connection to said second end of said operating arm.

18. The electric circuit breaker defined in claim 15, which further includes an arc chamber molded in said case, for accommodating said fixed and movable contacts, a line strap extending into said arc chamber and having a bent-back termination to which one of said fixed contacts is mounted, a load strap extending into said arc chamber and having a bent-back termination to which the other of said fixed contacts is mounted, whereby blowout forces are created during a interruption for propelling the resulting arc out of said arc chamber into said vent passage.

19. In an electric circuit breaker having a trip mechanism, a pair of fixed contacts, and a pair of movable contacts mounted by a reciprocating contact carrier, an operating mechanism comprising, in combination:

A. a frame having first and second pivot posts;

B. an operating member pivotally mounted on said first pivot post, said operating member having a first end operatively connected to the contact carrier and a second end;

C. a latchable member pivotally mounted on said second pivot post, said latchable member being normally restrained against pivotal movement by the trip mechanism;

D. a cam link having a first end pivotally connected to said second end of said operating member and a second end;

E. an interconnecting link pivotally interconnecting said second end of said cam link to said latchable member;

F. an operating spring acting between the contact carrier and said cam link to power a trip function of the circuit breaker; and G. an operating handle movable between ON and OFF positions, said handle mounting a cam acting on said cam link during handle movement to articulate said operating mechanism pursant to reciprocating said carrier and thereby translate the movable contacts between positions of engaging and disengaging relation with the fixed contacts.

20. The operating mechanism defined in claim 19, wherein said operating spring is in the form of a hairpin spring having a first resilient leg acting on said contact carrier to abruptly separate the fixed and movable contacts and a second resilient leg operating on said cam link to automatically resist said operating mechanism immediately following a trip function.

21. The operating mechanism defined in claim 20, wherein said cam link includes a cam surface acted upon by said second spring resilient leg to assist said first resilient leg in achieving separation of the fixed and movable contacts during a trip function.

22. The operating mechanism defined in claim 21, wherein the pivotal connection between operating mechanism parts is effected by providing a pivot post on one part which is received in an opening in the other interconnected part.

23. The operating mechanism defined in claim 22, which further includes a handle spring biasing said operating handle toward said OFF position, and said handle cam comprising a leading cam surface and a trailing cam surface separated by a cam peak, said leading cam surface operating on said cam link during movement of said operating handle toward said ON position to effect rotation of said operating member about said first pivot post, thereby to reciprocate said carrier and translate the movable contacts into engaging relation with the fixed contacts, said operating spring urging said cam link against said trailing cam surface while the contacts are in engaging relation to sustain said ON position of said operating handle agains the biasing of said operating handle spring.

24. The operating mechanism defined in claim 23, wherein said cam link includes a cam surface acted upon by said operating spring upon release of said latchable member by the trip mechanism to urge said cam link along said trailing cam surface to thereby accelerate the release of the contact carrier by said operating member and thus facilitate the abrupt separation of the contacts by said operating spring.

25. The operating mechanism defined in claim 24, wherein said operating spring is in the form of a hairpin spring having a first resilient leg acting on the contact carrier and a second resilient leg acting on said cam link, said second resilient leg being operative, upon return of said operating handle to said OFF position by said handle spring immediately following a trip function, to automatically articulate the operating mechanism parts into a reset position.

26. The operating mechanism defined in claim 25, wherein said frame includes means defining an opening therein accommodating said hairpin spring for retention in its operative position.

* * * * *